US009902913B2

(12) United States Patent
Vaughn et al.

(10) Patent No.: US 9,902,913 B2
(45) Date of Patent: Feb. 27, 2018

(54) BASESTOCK PRODUCTION FROM FEEDS CONTAINING SOLVENT EXTRACTS

(71) Applicants: Nicole D. Vaughn, Mullica Hill, NJ (US); Teck-Mui Hoo, Centreville, VA (US); Michael B. Carroll, Center Valley, PA (US); Stuart S. Shih, Gainesville, VA (US); Eric D. Joseck, Burke, VA (US); William J. Novak, Bedminster, NJ (US)

(72) Inventors: Nicole D. Vaughn, Mullica Hill, NJ (US); Teck-Mui Hoo, Centreville, VA (US); Michael B. Carroll, Center Valley, PA (US); Stuart S. Shih, Gainesville, VA (US); Eric D. Joseck, Burke, VA (US); William J. Novak, Bedminster, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 180 days.

(21) Appl. No.: 14/629,997

(22) Filed: Feb. 24, 2015

(65) Prior Publication Data

US 2015/0275106 A1 Oct. 1, 2015

Related U.S. Application Data

(60) Provisional application No. 61/971,633, filed on Mar. 28, 2014.

(51) Int. Cl.
*C10G 45/58* (2006.01)
*C10L 1/08* (2006.01)
(Continued)

(52) U.S. Cl.
CPC ..... *C10G 67/02* (2013.01); *C10G 65/043* (2013.01); *C10G 65/12* (2013.01); *C10M 101/02* (2013.01);
(Continued)

(58) Field of Classification Search
None
See application file for complete search history.

(56) References Cited

U.S. PATENT DOCUMENTS 4,259,170 A 3/1981 Graham et al.
6,773,578 B1 8/2004 O'Rear et al.
(Continued)

OTHER PUBLICATIONS

The International Search Report and Written Opinion of PCT/US2015/017982 dated Apr. 28, 2015.
(Continued)

*Primary Examiner* — Tam M Nguyen
(74) *Attorney, Agent, or Firm* — Scott F. Yarnell; Amanda K. Jenkins

(57) ABSTRACT

Methods are provided for producing Group II/III lubricant base oil products where at least a portion of the feedstock for forming the lubricant base oil product is a solvent extract fraction from a Group I lubricant production facility. This can increase the overall volume of feedstock available for production of Group II/III lubricant base oils by using a lower value stream (Group I solvent extract) as a portion of the feedstock. The solvent extract fraction can be added to a full range lubricant feedstock or to a portion of a lubricant feedstock, such as adding an extract fraction to a higher viscosity portion (such as a heavy neutral portion) of a feedstock for lubricant production, while a lower viscosity portion (such as a light neutral portion) is processed without addition of an extract fraction.

17 Claims, 3 Drawing Sheets

(51) Int. Cl.

| | |
|---|---|
| ***C10G 67/02*** | (2006.01) |
| ***C10M 101/02*** | (2006.01) |
| ***C10G 65/04*** | (2006.01) |
| ***C10G 65/12*** | (2006.01) |

(52) U.S. Cl.
CPC ..... *C10G 2300/1096* (2013.01); *C10G 2300/301* (2013.01); *C10G 2400/10* (2013.01)

(56) References Cited

U.S. PATENT DOCUMENTS

| | | | |
|---|---|---|---|
| 7,354,508 | B2 | 4/2008 | Adams et al. |
| 2014/0042056 | A1 | 2/2014 | Daage et al. |

OTHER PUBLICATIONS

"Vacuum Gas Oil," Houston Refining, 2006, Retrieved from the Internet: http://www.lyondellbasell.com/techlit/techlit/refining/REV-APO248_VACUUM_GAS_OIL_VGO.pdf.

Pitault, Isabelle et al., "Kinetic Model Based on a Molecular Description for Catalytic Cracking of Vacuum Gas Oil," Chemical Engineering Science, 1994, pp. 4249-4262, vol. 49, Issue 24.

| Example-II Feed Composition and Analyses | | | | | | | | |
|---|---|---|---|---|---|---|---|---|
| | | HN Extract | LN Extract | Gp I Wax | Light Distillate | Medium Distillate | Heavy Distillate | Blended Feed |
| Composition | vol% | 4.1 | 10.7 | 3.1 | 6.0 | 40.1 | 36.0 | 100.0 |
| Density @ 100C | | 0.9577 | 0.9483 | 0.7908 | 0.8601 | 0.8652 | 0.8944 | 0.8858 |
| Density @ 70C | | 0.9763 | 0.9678 | 0.8092 | 0.8794 | 0.884 | 0.9129 | |
| Sulfur | wt% | 4.69 | 4.57 | 0.601 | 2.26 | 2.93 | 3.53 | 3.02 |
| Nitrogen | ppmw | 2049 | 1372 | 33 | 513 | 715 | 1363 | 1075 |
| Distillation (D2887) | | | | | | | | |
| IBP | F | 698 | 599 | 590 | 618 | 580 | 679 | 598 |
| 10% | F | 827 | 706 | 859 | 715 | 691 | 839 | 732 |
| 30% | F | 976 | 749 | 905 | 759 | 759 | 921 | 816 |
| 50% | F | 910 | 779 | 942 | 790 | 809 | 970 | 882 |
| 70% | F | 950 | 907 | 983 | 818 | 856 | 1013 | 951 |
| 90% | F | 1012 | 838 | 1043 | 848 | 917 | 1070 | 1036 |
| EBP | F | 1157 | 882 | 1144 | 895 | 1010 | 1214 | 1162 |
| Total Aromatics | μmole/g | 1859 | 2260.5 | 265.0 | 1222.2 | 1220.5 | 1158.7 | 1248.4 |
| 1 Ring Aromatics | μmole/g | 132.9 | 299.1 | 207.1 | 364.2 | 323 | 222.9 | 268.1 |
| 2 Rings Aromatics | μmole/g | 647.4 | 760.4 | 38.6 | 367.7 | 373.8 | 372.6 | 396 |
| 3+ Rings Aromatics | μmole/g | 1078.7 | 1201 | 17.2 | 490 | 523.7 | 563.2 | 584.3 |
| Dry Wax | wt% | 3.5 | 1.9 | 82.3 | 8.27 | 11.53 | 12.9 | 13.5 |

FIG. 3

BASESTOCK PRODUCTION FROM FEEDS CONTAINING SOLVENT EXTRACTS

CROSS-REFERENCE TO RELATED APPLICATIONS

This application claims priority to U.S. Provisional Application Ser. No. 61/971,633 filed Mar. 28, 2014, which is herein incorporated by reference in its entirety.

FIELD

Systems and methods are provided for production of lubricant oil basestocks.

BACKGROUND

Dewaxing is a commonly used technique for improving the properties of a petroleum fraction for use in various products, such as fuels or lubricant base stocks. Historically, solvent dewaxing was the first type of dewaxing used for modifying the properties of a feedstock. Solvent extraction and dewaxing allowed for separation of a feedstock into a raffinate fraction for use as a distillate fuel or lubricant, an aromatics fraction, and a waxy fraction. More recently, catalytic dewaxing has been commonly used for improving the properties of feeds for use in fuels or lubricant base stocks.

U.S. Pat. No. 4,259,170 describes a process for manufacturing lube basestocks. In the process, one or more lower boiling fractions from a vacuum distillation tower are solvent dewaxed to form lubricant base stocks. One or more higher boiling fractions are catalytically dewaxed in order to provide a pour point improvement for the higher boiling fractions that is greater than the amount that can be achieved by solvent dewaxing.

U.S. Pat. No. 6,773,578 describes a process for preparing lubes with high viscosity index values. The process includes obtaining a first feedstock that includes at least 95% of material that boils below 1150° F. (621° C.), and a second feedstock that includes at least 95% of material that boils above 1150° F. (621° C.). The feedstock containing the portion that boils below 1150° F. is catalytically dewaxed. The feedstock containing the portion that boils above 1150° F. is solvent dewaxed and optionally also catalytically dewaxed. Performing solvent dewaxing on the above 1150° F. portion is described as reducing the difference between the cloud point and the pour point for the resulting products.

U.S. Pat. No. 7,354,508 describes a process for preparing a heavy and a light lubricating base oil. A feedstock for forming lubricant basestocks is separated into a lower boiling fraction and a higher boiling fraction. The lower boiling fraction and higher boiling fraction are dewaxed under different conditions. Solvent dewaxing is generally mentioned as a type of dewaxing. However, catalytic dewaxing is identified as the preferred type of dewaxing for dewaxing of both fractions.

SUMMARY

In an aspect, a method for forming a lubricant product is provided. The method includes providing a feedstock having a T5 boiling point of at least 600° F. (343° C.) and a T95 boiling point of 1150° F. (621° C.) or less; combining the feedstock with an extract fraction to form a combined feed, the extract fraction having a total aromatics content of at least 1500 μmole/g (e.g., at least 1700 μmole/g or at least 1800 μmole/g) and one or more of a 3+ ring aromatics content of at least 1000 μmole/g (e.g., at least 1050 μmole/g or at least 1200 μmole/g), a nitrogen content of at least 1300 ppm by weight (e.g., at least 1400 ppm by weight or at least 1500 ppm by weight), or a sulfur content of at least 4.5 wt % (e.g., at least 4.65 wt % or at least 4.8 wt %), the combined feed having a total aromatics content of at least 1240 μmole/g; hydroprocessing the combined feed under first effective hydroprocessing conditions in the presence of a hydrocracking catalyst to form a hydroprocessed effluent, the first effective hydroprocessing conditions comprising a hydrogen partial pressure of at least 1500 psig (10.3 MPag); hydroprocessing at least a portion of the liquid phase effluent in the presence of at least a dewaxing catalyst under second effective hydroprocessing conditions to form a dewaxed effluent; and fractionating the dewaxed effluent to form at least a lubricant base oil product having a viscosity index of at least 90 at a pour point of −18° C. or less, a sulfur content of 300 wppm or less, and an aromatics content of 10 wt % or less.

BRIEF DESCRIPTION OF THE DRAWINGS

FIG. 3 shows the composition of a combined feed for forming a lubricant basestock.

DETAILED DESCRIPTION

Figure 1:
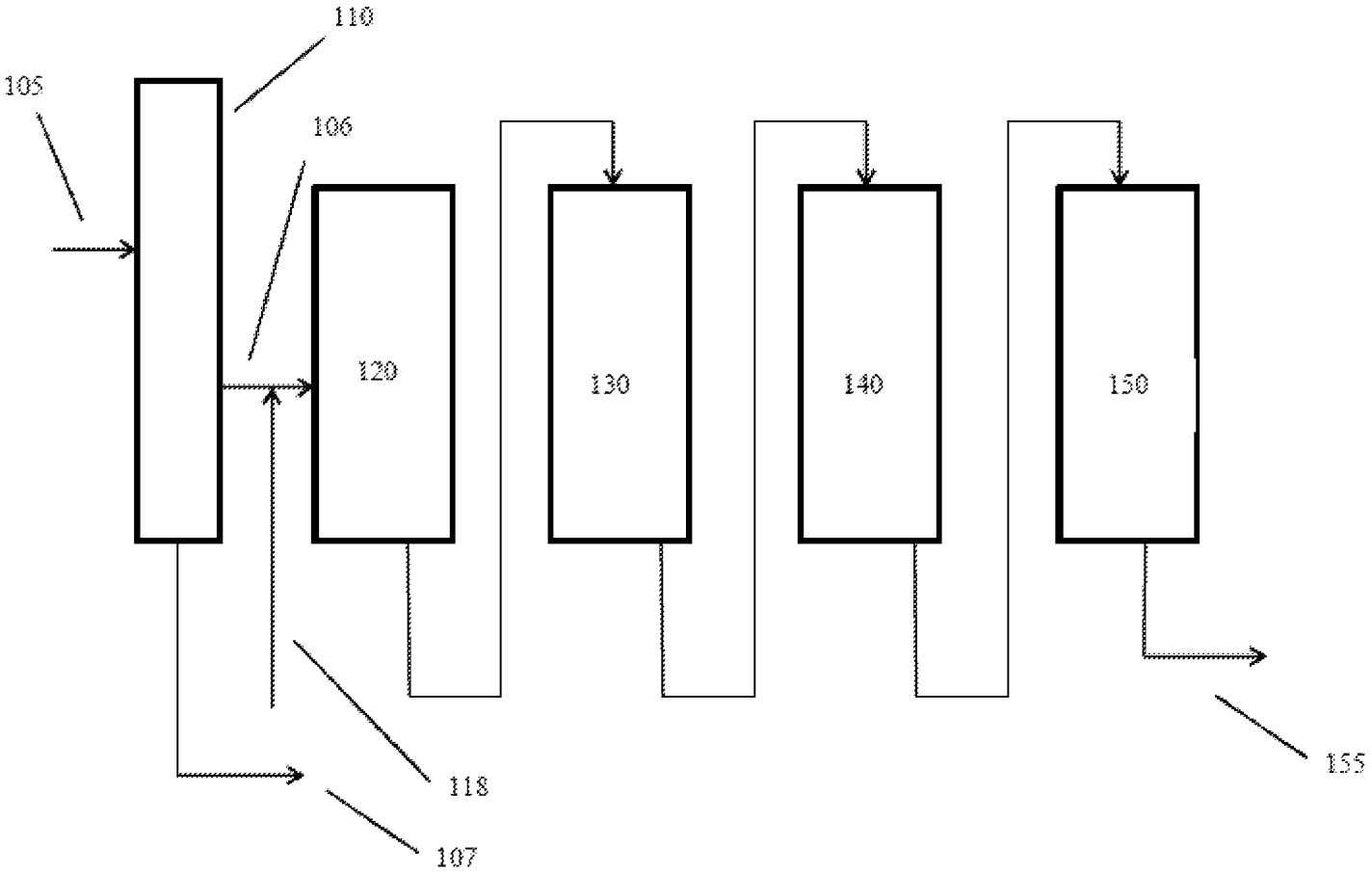
FIG. 1 schematically shows an example of a configuration suitable for processing a combined feed to produce lubricant basestock products.

All numerical values within the detailed description and the claims herein are modified by "about" or "approximately" the indicated value, and take into account experimental error and variations that would be expected by a person having ordinary skill in the art.

Overview

In various aspects, methods are provided for producing Group II/III lubricant base oil products where at least a portion of the feedstock for forming the lubricant base oil product is a solvent extract fraction from a Group I lubricant production facility. This can increase the overall volume of feedstock available for production of Group II/III lubricant base oils by using a lower value stream (Group I solvent extract) as a portion of the feedstock. In some aspects, the solvent extract fraction can be added to a higher viscosity portion (such as a heavy neutral portion) of a feedstock for lubricant production, while a lower viscosity portion (such as a light neutral portion) is processed without addition of an extract fraction. In other aspects, the solvent extract fraction can be added to a full range lubricant feedstock.

Traditionally, a solvent extract fraction generated during production of a Group I base oil is generally viewed as an undesirable feed for production of Group II/III basestocks via catalytic processing. The solvent extract fraction(s) from solvent processing to form a Group I basestock generally have a large concentration of aromatics (including 3+ ring aromatics), a high sulfur content, and/or a high nitrogen content. Further, such extract fractions typically do not have a large quantity of the types of molecules that are desirable for improving the properties of a lubricant base oil, such as compounds that tend to lead to high viscosity index (VI) values.

It has been unexpectedly discovered that a substantial portion of a solvent extract fraction can be incorporated into the feedstock for production of Group II/III lubricant base oils. In some aspects, the process is enabled in part by performing a conversion process on the feedstock under sufficiently high $H_2$ partial pressure. Processing the combined feedstock and extract fraction(s) at sufficiently high $H_2$ partial pressure can allow combined feedstock and extract fraction feed to have an aromatics content, sulfur content, and/or nitrogen content that is conventionally considered not suitable for production of Group II/III base oils. However, it has been discovered that such combined feeds can be used for lubricant base oil production to make Group II, Group II+, Group III, or Group III+ lubricant base oils at desirable yield levels.

Group I basestocks or base oils are defined as base oils with less than 90 wt % saturated molecules and/or at least 0.03 wt % sulfur content. Group I basestocks also have a viscosity index (VI) of at least 80 but less than 120. Group II basestocks or base oils contain at least 90 wt % saturated molecules and less than 0.03 wt % sulfur. Group II basestocks also have a viscosity index of at least 80 but less than 120. Group III basestocks or base oils contain at least 90 wt % saturated molecules and less than 0.03 wt % sulfur, with a viscosity index of at least 120. In addition to the above formal definitions, some Group I basestocks may be referred to as a Group I+ basestock, which corresponds to a Group I basestock with a VI value of 103 to 108. Some Group II basestocks may be referred to as a Group II+ basestock, which corresponds to a Group II basestock with a VI of at least 113. Some Group III basestocks may be referred to as a Group III+ basestock, which corresponds to a Group III basestock with a VI value of at least 140.

Conventionally, a feedstock for lubricant base oil production is processed either using solvent dewaxing or using catalytic dewaxing. For example, in a lube solvent plant, a vacuum gas oil (VGO) or another suitable feed is fractionated into light neutral (LN) and heavy neutral (HN) distillates and a bottom fraction by some type of vacuum distillation. The bottoms fraction is subsequently deasphalted to recover an asphalt fraction and a brightstock. The LN distillate, HN distillate, and brightstock are then solvent extracted to remove the most polar molecules as an extract and corresponding LN distillate, HN distillate, and brightstock raffinates. The raffinates are then solvent dewaxed to obtain a LN distillate, HN distillate, and brightstock basestocks with acceptable low temperature properties. It is beneficial to hydrofinish the lubricant basestocks either before or after the solvent dewaxing step. The resulting lubricant basestocks may contain a significant amount of aromatics (up to 25%) and high sulfur (>300 ppm). Thus, the typical base oils formed from solvent dewaxing alone are Group I basestocks.

For production of lubricant base oils in an all catalytic process, a VGO (or another suitable feed) is hydrocracked under medium pressure conditions to obtain a hydrocraker bottoms with reduced sulfur and nitrogen contents. One or more LN and/or HN distillate fractions may then be recovered from the desulfurized hydrocracker bottoms. The recovered fractions are then catalytically dewaxed, such as by using a shape selective dewaxing catalyst, followed by hydrofinishing. This process typically results in production of Group II, Group II+, Group III, and/or Group III+ base oils.

In various aspects, the amount of lubricating basestock yield can be determined based on the fraction of the hydroprocessed product corresponding to an 700° F.+(371° C.+) or 725° F. (385° C.) product having properties that satisfy the requirements for a Group II, Group II+, Group III, or Group III+ basestock. The basestock yield can also be dependent on the desired pour point for the basestock. In some aspects, the lubricating basestock can have a viscosity index (VI) of at least 90 at a pour point of −15° C. or less, such as −18° C. or less, or −20° C. or less, or −25° C. or less. In some aspects, the lubricating basestock can have a viscosity index (VI) of at least 103 at a pour point of −15° C. or less, such as −18° C. or less, or −20° C. or less, or −25° C. or less. In some aspects, the lubricating basestock can have a viscosity index (VI) of at least 120 at a pour point of −15° C. or less, such as −18° C. or less, or −20° C. or less, or −25° C. or less. In some aspects, the lubricating basestock can have a viscosity index (VI) of at least 140 at a pour point of −15° C. or less, such as −18° C. or less, or −20° C. or less, or −25° C. or less.

In addition to lubricating basestock(s), the methods described herein will generally result in production of at least one naphtha boiling range fraction, at least one distillate fuel boiling range fraction. Products or fractions having a boiling range of 350° F. (177° C.) or 375° F. (191° C.) to 700° F. (371° C.) or 725° F. (385° C.) are generally considered distillate fuel products or fractions such as diesel fuel or kerosene. Products or fractions having a boiling range from 100° F. (or alternatively from 97° F., the boiling point of n-pentane) to 350° F. (177° C.) or 375° F. (191° C.) are generally considered naphtha products or fractions.

Feedstocks

A wide range of petroleum and chemical feedstocks can be hydroprocessed in accordance with the disclosure. Suitable feedstocks include whole and reduced petroleum crudes, atmospheric and vacuum residua, propane deasphalted residua, e.g., brightstock, cycle oils, FCC tower bottoms, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials. In various aspects, the above feedstocks can be combined with a solvent extract fraction from a second lubricant feedstock in order to increase the available volume available for lubricant basestock production.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

Typical feeds for lubricant basestock production include, for example, feeds with an initial boiling point of at least 600° F. (316° C.), or at least 650° F. (343° C.), or at least 700° F. (371° C.), or at least 750° F. (399° C.). Alternatively, a feed may be characterized using a T5 boiling point, such as a feed with a T5 boiling point of at least 600° F. (316° C.), or at least 650° F. (343° C.), or at least 700° F. (371° C.), or at least 750° F. (399° C.). In some aspects, the final boiling point of the feed can be at least 1100° F. (593° C.), such as at least 1150° F. (621° C.) or at least 1200° F. (649° C.). In other aspects, a feed may be used that does not include a large portion of molecules that would traditional be considered as vacuum distillation bottoms. For example, the feed may correspond to a vacuum gas oil feed that has already been separated from a traditional vacuum bottoms portion. Such feeds include, for example, feeds with a final boiling point of 1150° F. (621° C.), or 1100° F. (593° C.) or less, or 1050° F. (566° C.) or less. Alternatively, a feed may be characterized using a T95 boiling point, such as a feed with a T95 boiling point of 1150° F. (621° C.) or less, or 1100° F. (593° C.) or less, or 1050° F. (566° C.) or less. An example of a suitable type of feedstock is a wide cut vacuum gas oil (VGO) feed, with a T5 boiling point of at least 600° F. (316° C.), such as at least 650° F. (343° C.), and a T95 boiling point of 1100° F. or less. Optionally, the initial boiling point of such a wide cut VGO feed can be at least 575° F. (302° C.) and/or the final boiling point can be at least 1100° F. It is noted that feeds with still lower initial boiling points and/or T5 boiling points may also be suitable, so long as sufficient higher boiling material is available so that the overall nature of the process is a lubricant base oil production process and/or a fuels hydrocracking process.

In various aspects, prior to addition of a solvent extract portion to a feedstock, the sulfur content of a feedstock can be at least 300 ppm by weight of sulfur, or at least 1000 wppm, or at least 2000 wppm, or at least 4000 wppm, or at least 10,000 wppm, or at least 20,000 wppm. Additionally or alternately, the sulfur content can be 25,000 wppm or less, or 10,000 wppm or less, or 5000 wppm or less, or 1000 wppm or less. As described in more detail below, the sulfur content and/or the nitrogen content of the feedstock can be increased by addition of a solvent extract fraction.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

The biocomponent feeds usable in the present disclosure can include any of those which comprise primarily triglycerides and free fatty acids (FFAs). The triglycerides and FFAs typically contain aliphatic hydrocarbon chains in their structure having from 8 to 36 carbons, preferably from 10 to 26 carbons, for example from 14 to 22 carbons. Types of triglycerides can be determined according to their fatty acid constituents. The fatty acid constituents can be readily determined using Gas Chromatography (GC) analysis. This analysis involves extracting the fat or oil, saponifying (hydrolyzing) the fat or oil, preparing an alkyl (e.g., methyl) ester of the saponified fat or oil, and determining the type of (methyl) ester using GC analysis. In one embodiment, a majority (i.e., greater than 50%) of the triglyceride present in the lipid material can be comprised of $C_{10}$ to $C_{26}$, for example $C_{12}$ to $C_{18}$, fatty acid constituents, based on total triglyceride present in the lipid material. Further, a triglyceride is a molecule having a structure substantially identical to the reaction product of glycerol and three fatty acids. Thus, although a triglyceride is described herein as being comprised of fatty acids, it should be understood that the fatty acid component does not necessarily contain a carboxylic acid hydrogen. Other types of feed that are derived from biological raw material components can include fatty acid esters, such as fatty acid alkyl esters (e.g., FAME and/or FAEE).

In embodiments where at least a portion of the feed is of a biocomponent origin, that portion can be at least 2 wt %, for example at least 5 wt %, at least 10 wt %, at least 20 wt %, at least 25 wt %, at least 35 wt %, at least 50 wt %, at least 60 wt %, or at least 75 wt %. Additionally or alternately, the biocomponent portion can be 75 wt % or less, for example 60 wt % or less, 50 wt % or less, 35 wt % or less, 25 wt % or less, 20 wt % or less, 10 wt % or less, or 5 wt % or less.

The content of sulfur, nitrogen, and oxygen in a feedstock created by blending two or more feedstocks can typically be determined using a weighted average based on the blended feeds. For example, a mineral feed and a biocomponent feed can be blended in a ratio of 80 wt % mineral feed and 20 wt % biocomponent feed. In such a scenario, if the mineral feed has a sulfur content of 1000 wppm, and the biocomponent feed has a sulfur content of 10 wppm, the resulting blended feed could be expected to have a sulfur content of 802 wppm.

Formation of a Solvent Extract Fraction (Solvent Processing for Production of Group I Basestock)

During production of Group I basestocks via solvent processing, a commonly generated stream is a solvent extract output stream. The solvent extraction process generates a raffinate that includes the eventual desired basestock, and an extract stream containing polar molecules. The polar molecules in the extract stream can include a variety of sulfur compounds, nitrogen compounds, and aromatics including multi-ring aromatics.

For example, after an optional solvent deasphalting process, a feedstock for forming a Group I lubricant basestock can be processed first by solvent extraction and then be solvent dewaxing. Solvent extraction is generally used to reduce the aromatics content and/or the amount of polar molecules in a feedstock. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted bottoms, the raffinate phase can have an aromatics content of 5 wt % to 25 wt %. For typical feeds, the aromatics contents will be at least 10 wt %.

In some aspects, a feedstock can be fractionated into various fractions prior to solvent extraction. For example, a feedstock can be fractionated into a lower boiling fraction (such as a light neutral fraction), a higher boiling fraction (such as a heavy neutral fraction), and optionally a bottoms fraction (such as a brightstock fraction) as described above. In such aspects, solvent extraction can be performed on each of the separate boiling range fractions. This can allow for formation of extracts from the separate boiling range fractions, so that the relative amounts of extract corresponding to each boiling range can be added independently. This can allow for greater control over the composition of the combined feed (i.e., distillate feedstock and extract) used for formation of Group II/III lubricant basestocks.

In various aspects, an extract fraction that is added to a feedstock for production of a Group II/III lubricant basestock can have various properties that are typically not associated with a suitable feed for production of Group II/III basestocks. For example, an extract fraction can have a total aromatics content of at least 1500 μmole/g, such as at least 1700 μmole/g or at least 1800 μmole/g, such as up to 3000 μmole/g. Additionally or alternately, an extract fraction can have a 3+ ring aromatics content of at least 1000 μmole/g, such as at least 1050 μmole/g or at least 1200 μmole/g. Additionally or alternately, an extract fraction can have a nitrogen content of at least 1300 ppm by weight, such as at least 1400 ppm by weight or at least 1500 ppm by weight, such as up to 5000 ppm by weight. Additionally or alternately, an extract fraction can have a sulfur content of at least 4.5 wt %, such as at least 4.65 wt % or at least 4.8 wt %, such as up to 6.5 wt %. A suitable extract fraction can have at least one of the above features, or a combination of any two of the above features, or a combination of any three of the above features, or a combination of all four of the above features.

With regard to formation of a Group I basestock via solvent processing, after solvent extraction the raffinate from the solvent extraction can optionally but preferably be under-extracted. In such preferred aspects, the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. The raffinate from the solvent extraction unit can then be solvent dewaxed under solvent dewaxing conditions to remove hard waxes from the raffinate.

Solvent dewaxing typically involves mixing the raffinate feed from the solvent extraction unit with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between 1 to 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added will be sufficient to provide a liquid/solid weight ratio between the range of 5/1 and 20/1 at the dewaxing temperature and a solvent/oil volume ratio between 1.5/1 to 5/1. The solvent dewaxed oil is typically dewaxed to an intermediate pour point, preferably less than +10° C., such as less than 5° C. or less than 0° C. The resulting solvent dewaxed oil is suitable for use in forming one or more types of Group I base oils. The aromatics content will typically be greater than 10 wt % in the solvent dewaxed oil. Additionally, the sulfur content of the solvent dewaxed oil will typically be greater than 300 wppm.

Combining Extract Fractions with Feedstock for Basestock Production

In various aspects, a feedstock can be combined with one or more extract fractions to form a feed that can be used to produce a Group II/III basestock. The amount of extract that can be added to a feedstock may depend on the nature of the extract(s), the nature of the feedstock, and the desired type of lubricant basestock product. When producing a heavy neutral basestock, such as a basestock with a viscosity at 100° C. of at least 6.1 cSt, and/or when producing a Group II or Group II+ basestock, the combination of feedstock and extract(s) prior to processing can have one or more of the following characteristics. For production of a heavy neutral and/or Group II/II+ basestock, the combination of feedstock and extract(s) can have a total aromatics content of at least 1420 μmole/g, such as at least 1500 μmole/g or at least 1600 μmole/g, such as up to 2500 μmole/g. Additionally or alternately, the combination of feedstock and extract fraction(s) can have a 3+ ring aromatics content of at least 700 μmole/g, such as at least 850 μmole/g or at least 1000 μmole/g. Additionally or alternately, the combination of feedstock and extract fraction(s) can have a nitrogen content of at least 1400 ppm by weight, such as at least 1500 ppm by weight or at least 1600 ppm by weight, such as up to 3000 ppm by weight. Additionally or alternately, the combination of feedstock and extract fraction(s) can have a sulfur content of at least 3.5 wt %, such as at least 3.65 wt % or at least 3.8 wt %, such as up to 6 wt %. The combination of feedstock and extract fraction(s) can have at least one of the above features, or a combination of any two of the above features, or a combination of any three of the above features, or a combination of all four of the above features.

When producing a light neutral basestock, such as a basestock with a viscosity at 100° C. of 6 cSt or less, and/or when producing a Group III or Group III+ basestock, the combination of feedstock and extract(s) prior to processing can have one or more of the following characteristics. For production of a light neutral and/or Group III/III+ basestock, the combination of feedstock and extract(s) can have a total aromatics content of at least 1240 μmole/g, such as at least 1350 μmole/g or at least 1450 μmole/g, such as up to 2500 μmole/g. Additionally or alternately, the combination of feedstock and extract fraction(s) can have a 3+ ring aromatics content of at least 580 μmole/g, such as at least 650 μmole/g or at least 725 μmole/g. Additionally or alternately, the combination of feedstock and extract fraction(s) can have a nitrogen content of at least 1000 ppm by weight, such as at least 1200 ppm by weight or at least 1400 ppm by weight, such as up to 2500 ppm by weight. Additionally or alternately, the combination of feedstock and extract fraction(s) can have a sulfur content of at least 3.0 wt %, such as at least 3.25 wt % or at least 3.5 wt %, such as up to 5 wt %. The combination of feedstock and extract fraction(s) can have at least one of the above features, or a combination of any two of the above features, or a combination of any three of the above features, or a combination of all four of the above features.

The amount of extract fraction(s) added to a feedstock for lubricant basestock production can vary depending on the nature of the feedstock. One consideration is to add enough of the extract fraction to produce a combined feed that has one or more of the aromatics content, 3+ ring aromatics content, nitrogen content, or sulfur content features as described above. Another consideration is to retain a high enough concentration of feedstock in the combined feed so that a desirable yield of lubricant basestock is still achieved. In various aspects, the amount of one or more extract fractions added to a feedstock for lubricant basestock production can correspond to at least 1 vol % of the combined feed, such as at least 3 vol % of the combined feed, or at least 5 vol %, or at least 10 vol %, or at least 15 vol %, or at least 20 vol %, or at least 25 vol %. Additionally or alternately, the amount of one or more extract fractions added to a feedstock for lubricant basestock production can correspond to 40 vol % of the combined feed or less, such as 35 vol % or less of the combined feed, or 30 vol % or less, or 25 vol % or less, or 20 vol % or less.

In some aspects, at least two lubricant base oil products can be made from a feedstock, such as a vacuum gas oil feedstock. If it is desired to form two or more lubricant base oil products, a separation can be performed prior to addition of extract fractions, so that the extract fractions can be added to only one of the separated feedstock portions or fewer than all of the separated feedstock portions. As an initial process, a suitable feedstock can be separated to form at least a lower boiling feedstock portion, a higher boiling feedstock portion, and (optionally) a bottoms portion. Such a separation can be performed, for example, using a vacuum distillation unit. One method for determining the amounts in the various portions is by selecting cut point temperatures. The cut point temperatures may vary depending on the nature of the feedstock. Generally, the cut point between the lower boiling portion and the higher boiling portion can be between 850° F. (454° C.) and 950° F. (510° C.), such as at least 875° F. (468° C.) or less than 925° F. (496° C.) or less than 900° F. (482° C.). The cut point between the higher boiling portion and the bottoms portion can be between 1050° F. (566° C.) and 1150° F. (621° C.), such as less than 1100° F. (593° C.). In some alternative aspects, it may be desirable to increase the relative amount of light neutral base oils that are produced. In such aspects, the cut point between the lower boiling portion and the higher boiling portion may be higher, such as at least 950° F. (510° C.), or at least 1000° F. (538° C.), and less than 1150° F. (621° C.), such as less than 1100° F. (593° C.) or less than 1050° F. (566° C.).

It is noted that the above fractionation temperatures represent the split between lighter feedstock portions, heavier feedstock portions, and a bottoms portion. If desired, additional fractions could also be formed based on additional cut points. For the purposes of the discussion herein, any such additional fractions can be processed according to boiling range. Thus, if additional fractions are formed with a T95 boiling point of less than 850° F. (454° C.) to 950° F. (510° C.), all such additional fractions would be processed as part of the lower boiling feedstock portion.

After fractionation to form a lower boiling feedstock portion, a higher boiling feedstock portion, and a bottoms portion, each of the portions can be further processed. For example, the lower boiling feedstock portion can be hydroprocessed to form light neutral base oil(s), while the higher boiling feedstock portion can be hydroprocessed to form heavy neutral base oil(s) and/or light neutral base oil(s) having a higher viscosity at 100° C. than the base oil(s) formed from the lower boiling feedstock portion.

In some aspects, a feedstock may correspond to a feed where molecules traditionally considered as corresponding to a vacuum bottoms portion are not present, such as in a feed that corresponds to a vacuum gas oil from a previous vacuum distillation process. In such aspects, it may be desirable to form only the lighter feedstock portion and the heavier feedstock portion. Of course, some portion during the separation will correspond to a "bottoms", but the boiling range of such a "bottoms" will fall within the boiling range definition for the heavy portion of the feedstock. In these types of aspects, solvent deasphalting of a bottoms fraction is optional. Instead, all of the heavier portion of the feedstock after separation can be processed by solvent extraction followed by solvent dewaxing.

In still other aspects, it may be desirable to process the vacuum gas oil range portion of a feedstock as a single feed, as opposed to forming multiple boiling range fractions from the feedstock. In such aspects, the solvent extract fraction can be added to the feedstock and catalytically processed. Desired lubricant basestocks can then be separated from the full range product.

After any desired fractionation, one or more potential lubricant feedstocks will be available for processing to form lubricant basestocks. At least one of the potential lubricant feedstocks can then be combined with a solvent extract fraction to form a feedstock with increased volume.

Configurations for Processing Feedstocks to Form Group II/III Basestocks

Various types of hydroprocessing can be used in the production of lubricant base oils, including production of lubricant base oils as one of several products generated during a fuels hydrocracking process. Typical processes include a hydrocracking process to provide uplift in the viscosity index (VI) of the feed. The hydrocracked feed can then be dewaxed to improve cold flow properties, such as pour point or cloud point. The hydrocracked, dewaxed feed can then be hydrofinished, for example, to reduce the aromatics concentration of the lubricant base stock product. This can be valuable for removing compounds that are considered hazardous under various regulations. In addition to the above, a preliminary hydrotreatment and/or hydrocracking stage can also be used for contaminant removal.

In various aspects, the ability to incorporate extract fractions into feeds for production of lubricant basestocks is enabled at least in part by having at least one hydrocracking or other conversion stage in the hydroprocessing stages where the hydrogen partial pressure is at least 1500 psig (10.3 MPag), such as at least 1800 psig (12.4 MPag), or at least 2000 psig (13.8 MPag). Additionally or alternately, the hydrogen partial pressure can be 3000 psig (20.7 MPag) or less, such as 2750 psig (20.0 MPag) or less, or 2500 psig (17.2 MPag) or less. Having at least one hydrocracking or other conversion stage with a sufficient hydrogen partial pressure can allow the combined feed to have higher levels of undesirable components than typically would be acceptable while still allowing for production of Group II/III lubricant basestocks. Preferably, the at least one hydrocracking or other conversion stage comprises a stage where the combined feed is exposed to a hydrocracking catalyst under effective hydrocracking conditions as described herein.

In the discussion herein, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In the discussion herein, reference will be made to a hydroprocessing reaction system. The hydroprocessing reaction system corresponds to the one or more stages, such as two stages and/or reactors and an optional intermediate separator, that are used to expose a feed to a plurality of catalysts under hydroprocessing conditions. The plurality of catalysts can be distributed between the stages and/or reactors in any convenient manner, with some preferred methods of arranging the catalyst described herein.

FIG. 1 shows an example of a reaction system suitable for production of lubricant basestocks. In FIG. 1, a feed 105 is fractionated 110 to separate a resid portion 107 from lower boiling portions of the feed 106 that are suitable as a feedstock for lubricant basestock production. The lower boiling portions of the feed 106 are passed into a hydroprocessing reaction system. In the configuration in FIG. 1, the lower boiling portions of the feed 106 are combined with one or more solvent extract fractions 118 prior to entering the hydroprocessing reaction system. The hydroprocessing reaction system can include a hydrotreating stage 120, a hydrocracking stage 130, a dewaxing stage 140, and/or a hydrofinishing stage 150. As shown in FIG. 1, at least a portion of the effluent from each stage is passed into a subsequent stage until one or more lubricant basestock products 155 are generated. Optionally, the effluent from a stage can undergo a separation process (not shown) prior to being passed into a subsequent stage. For example, the effluent from a hydrotreating or hydrocracking stage can be subjected to a gas-liquid separation process to remove light ends (C4 or less) and/or contaminant gases such as $H_2S$ or $NH_3$. Similarly, a flash distillation or other separation can be performed after any convenient stage to remove compounds that do not need further processing, such as removing naphtha or diesel boiling range compounds from an effluent. This can reduce the amount of catalyst needed to process the remaining portion of the effluent.

Figure 2:
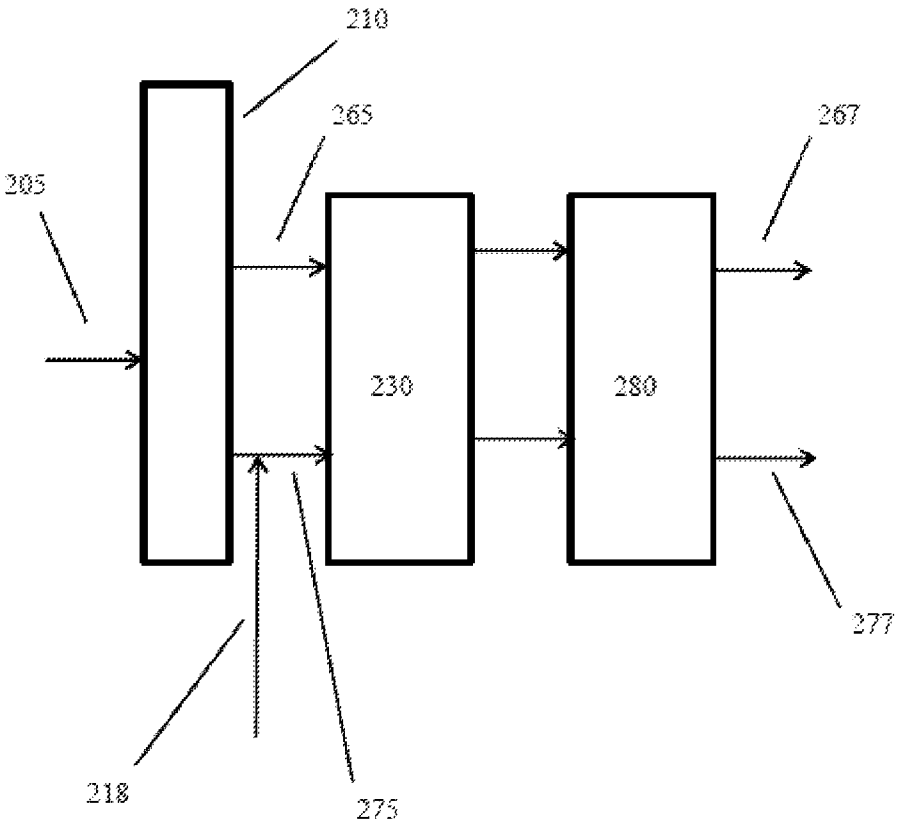
FIG. 2 schematically shows an example of another configuration suitable for processing a combined feed to produce lubricant basestock products.

FIG. 2 shows an alternative configuration where the hydroprocessing system can be operated in "block" operation. This can allow different feedstocks to be processed for production of different types or qualities of lubricant basestocks. For example, vacuum fractionator 210 can be used to generate one or more light (lower viscosity) feedstocks 265 and one or more heavy (higher viscosity) feedstocks 275. These feedstocks can be alternately passed through the hydroprocessing reaction system stages, so that at any one time only the feedstock 265 or the feedstock 275 is being processed in the reaction system. In the example shown in FIG. 2, a prior hydrotreatment stage is not used, so the feedstocks are initially passed into hydrocracking stage 230. Additionally, the dewaxing and hydrofinishing stages are shown as combined in a single reactor 280. In this block operation, the reaction conditions for the stages can optionally be adjusted to improve the yield for the different feedstocks. Because the light and heavy feedstocks are separated prior to hydroprocessing, the extract fraction(s) 218 can be added to less than all of the feedstocks. In FIG. 2, the extract fraction(s) 218 are added only to the heavy feedstock(s) 275. This can allow, for example, the production of light neutral base oil(s) 267 without any adjustment to account for additional extract fractions, while still using the extract fractions for production of heavy neutral base oil(s) 277.

Hydrotreatment Conditions

An initial hydrotreatment stage can optionally be used to reduce the amount of heteroatom contaminants in a combined feed that includes a portion of an extract fraction. Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. It is within the scope of the present disclosure that more than one type of hydroprocessing catalyst can be used in one or multiple reaction vessels.

The at least one Group VIII non-noble metal, in oxide form, can typically be present in an amount ranging from 2 wt % to 40 wt %, preferably from 4 wt % to 15 wt %. The at least one Group VI metal, in oxide form, can typically be present in an amount ranging from 2 wt % to 70 wt %, preferably for supported catalysts from 6 wt % to 40 wt % or from 10 wt % to 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least 50 vol. % and more preferably at least 75 vol. % hydrogen.

Hydrotreating conditions can include temperatures of 200° C. to 450° C., or 315° C. to 425° C.; pressures of 500 psig (3.4 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrocracking Conditions

In various aspects, the reaction conditions in the hydrocracking stage(s) in a reaction system can be selected to generate a desired level of conversion of a feed. Conversion of the feed can be defined in terms of conversion of molecules that boil above a temperature threshold to molecules below that threshold. The conversion temperature can be any convenient temperature, such as 700° F. (371° C.) or 725° F. (385° C.). The amount of conversion can correspond to the total conversion of molecules within any stage of the hydrocracker or other stage in the reaction system that is used to hydroprocess the combined feed. Suitable amounts of conversion of molecules boiling above 725° F. to molecules boiling below 725° F. include converting at least 10% of the 725° F.+ portion of the feedstock to the stage(s) of the reaction system, such as at least 20% of the 725° F.+ portion, or at least 30%. Additionally or alternately, the amount of conversion for the reaction system can be 85% or less of the 725° F.+ portion, or 70% or less, or 55% or less, or 40% or less. Still larger amounts of conversion may also produce a suitable hydrocracker bottoms for forming lubricant base oils, but such higher conversion amounts will also result in a reduced yield of lubricant base oils. Reducing the amount of conversion can increase the yield of lubricant base oils, but reducing the amount of conversion to below the ranges noted above may result in hydrocracker bottoms that are not suitable for formation of Group II, Group II+, or Group III lubricant base oils.

In order to achieve a desired level of conversion, a reaction system can include at least one hydrocracking catalyst. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least 20, and preferably at least 40 or 50. ZSM-48, such as ZSM-48 with a $SiO_2$ to $Al_2O_3$ ratio of 110 or less, such as 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least 0.1 wt % based on the total weight of the catalyst, for example at least 0.5 wt % or at least 0.6 wt %. Additionally or alternately when only one hydrogenation metal is present, the amount of that hydrogenation metal can be 5.0 wt % or less based on the total weight of the catalyst, for example 3.5 wt % or less, 2.5 wt % or less, 1.5 wt % or less, 1.0 wt % or less, 0.9 wt % or less, 0.75 wt % or less, or 0.6 wt % or less. Further additionally or alternately when more than one hydrogenation metal is present, the collective amount of hydrogenation metals can be at least 0.1 wt % based on the total weight of the catalyst, for example at least 0.25 wt %, at least 0.5 wt %, at least 0.6 wt %, at least 0.75 wt %, or at least 1 wt %. Still further additionally or alternately when more than one hydrogenation metal is present, the collective amount of hydrogenation metals can be 35 wt % or less based on the total weight of the catalyst, for example 30 wt % or less, 25 wt % or less, 20 wt % or less, 15 wt % or less, 10 wt % or less, or 5 wt % or less. In embodiments wherein the supported metal comprises a noble metal, the amount of noble metal(s) is typically less than 2 wt %, for example less than 1 wt %, 0.9 wt % or less, 0.75 wt % or less, or 0.6 wt % or less.

In various aspects, the conditions selected for hydrocracking for fuels hydrocracking and/or lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions.

A hydrocracking process under sour conditions can be carried out at temperatures of 550° F. (288° C.) to 840° F. (449° C.), hydrogen partial pressures of from 1500 psig to 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 1500 psig to 3000 psig (10.3 MPag-20.9 MPag), and hydrogen treat gas rates of from 213 $m^3/m^3$ to 1068 $m^3/m^3$ (1200 SCF/B to 6000 SCF/B). The LHSV relative to only the hydrocracking catalyst can be from 0.25 $h^{-1}$ to 50 $h^{-1}$, such as from 0.5 $h^{-1}$ to 20 $h^{-1}$, and preferably from 1.0 $h^{-1}$ to 4.0 $h^{-1}$.

In some aspects, a portion of the hydrocracking catalyst and/or the dewaxing catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as 350° F. (177° C.) or 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least 350° F. (177° C.) or at least 400° F. (204° C.) to having an upper end cut point temperature of 700° F. (371° C.) or less or 650° F. (343° C.) or less. Optionally, the distillate fuel range can be extended to include additional kerosene, such as by selecting a lower end cut point temperature of at least 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base oils. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of 550° F. (288° C.) to 840° F. (449° C.), hydrogen partial pressures of from 1500 psig to 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 1500 psig to 3000 psig (10.3 MPag-20.9 MPag), and hydrogen treat gas rates of from 213 $m^3/m^3$ to 1068 $m^3/m^3$ (1200 SCF/B to 6000 SCF/B). The liquid hourly space velocity can vary depending on the relative amount of hydrocracking catalyst used versus dewaxing catalyst. Relative to the combined amount of hydrocracking and dewaxing catalyst, the LHSV can be from 0.2 $h^{-1}$ to 10 $h^{-1}$, such as from 0.5 $h^{-1}$ to 5 $h^{-1}$ and/or from 1 $h^{-1}$ to 4 $h^{-1}$. Depending on the relative amount of hydrocracking catalyst and dewaxing catalyst used, the LHSV relative to only the hydrocracking catalyst can be from 0.25 $h^{-1}$ to 50 $h^{-1}$, such as from 0.5 $h^{-1}$ to 20 $h^{-1}$, and preferably from 1.0 $h^{-1}$ to 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of 550° F. (288° C.) to 840° F. (449° C.), hydrogen partial pressures of from 250 psig to 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF/B to 6000 SCF/B). The liquid hourly space velocity can vary depending on the relative amount of hydrocracking catalyst used versus dewaxing catalyst. Relative to the combined amount of hydrocracking and dewaxing catalyst, the LHSV can be from 0.2 $h^{-1}$ to 10 $h^{-1}$, such as from 0.5 $h^{-1}$ to 5 $h^{-1}$ and/or from 1 $h^{-1}$ to 4 $h^{-1}$. Depending on the relative amount of hydrocracking catalyst and dewaxing catalyst used, the LHSV relative to only the hydrocracking catalyst can be from 0.25 $h^{-1}$ to 50 $h^{-1}$, such as from 0.5 $h^{-1}$ to 20 $h^{-1}$, and preferably from 1.0 $h^{-1}$ to 4.0 $h^{-1}$.

Catalytic Dewaxing Process

In order to improve the quality of lubricant base oils produced from the reaction system, at least a portion of the catalyst in the reaction system, such as in a final reaction stage, can be a dewaxing catalyst. In some aspects, the dewaxing catalyst is located in a bed downstream from any hydrocracking catalyst stages and/or any hydrocracking catalyst present in a stage. This can allow the dewaxing to occur on molecules that have already been hydrotreated or hydrocracked to remove a significant fraction of organic sulfur- and nitrogen-containing species. Alternatively, the dewaxing catalyst can be located upstream from the hydrocracking stage(s). The dewaxing catalyst can be located in the same reactor as at least a portion of the hydrocracking catalyst in a stage. Alternatively, the effluent from a reactor containing hydrocracking catalyst, possibly after a gas-liquid separation, can be fed into a separate stage or reactor containing the dewaxing catalyst.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be less than 200:1, such as less than 110:1, or less than 100:1, or less than 90:1, or less than 75:1. In various embodiments, the ratio of silica to alumina can be from 50:1 to 200:1, such as 60:1 to 160:1, or 70:1 to 100:1.

In various embodiments, the catalysts according to the disclosure further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the disclosure can also include a binder. In some embodiments, the dewaxing catalysts used in process according to the disclosure are formulated using a low surface area binder, a low surface area binder represents a binder with a surface area of 100 $m^2/g$ or less, or 80 $m^2/g$ or less, or 70 $m^2/g$ or less. The amount of zeolite in a catalyst formulated using a binder can be from 30 wt % zeolite to 90 wt % zeolite relative to the combined weight of binder and zeolite. Preferably, the amount of zeolite is at least 50 wt % of the combined weight of zeolite and binder, such as at least 60 wt % or from 65 wt % to 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF. The liquid hourly space velocity can vary depending on the relative amount of hydrocracking catalyst used versus dewaxing catalyst. Relative to the combined amount of hydrocracking and dewaxing catalyst, the LHSV can be from 0.2 $h^{-1}$ to 10 $h^{-1}$, such as from 0.5 $h^{-1}$ to 5 $h^{-1}$ and/or from 1 $h^{-1}$ to 4 $h^{-1}$. Depending on the relative amount of hydrocracking catalyst and dewaxing catalyst used, the LHSV relative to only the dewaxing catalyst can be from 0.25 $h^{-1}$ to 50 $h^{-1}$, such as from 0.5 $h^{-1}$ to 20 $h^{-1}$, and preferably from 1.0 $h^{-1}$ to 4.0 $h^{-1}$.

Additionally or alternately, the conditions for dewaxing can be selected based on the conditions for a preceeding reaction in the stage, such as hydrocracking conditions or hydrotreating conditions. Such conditions can be further modified using a quench between previous catalyst bed(s) and the bed for the dewaxing catalyst. Instead of operating the dewaxing process at a temperature corresponding to the exit temperature of the prior catalyst bed, a quench can be used to reduce the temperature for the hydrocarbon stream at the beginning of the dewaxing catalyst bed. One option can be to use a quench to have a temperature at the beginning of the dewaxing catalyst bed that is the same as the outlet temperature of the prior catalyst bed. Another option can be to use a quench to have a temperature at the beginning of the dewaxing catalyst bed that is at least 10° F. (6° C.) lower than the prior catalyst bed, or at least 20° F. (11° C.) lower, or at least 30° F. (16° C.) lower, or at least 40° F. (21° C.) lower.

As still another option, the dewaxing catalyst in the final reaction stage can be mixed with another type of catalyst, such as hydrocracking catalyst, in at least one bed in a reactor. As yet another option, a hydrocracking catalyst and a dewaxing catalyst can be co-extruded with a single binder to form a mixed functionality catalyst.

Hydrofinishing and/or Aromatic Saturation Process

In some aspects, a hydrofinishing and/or aromatic saturation stage can also be provided. The hydrofinishing and/or aromatic saturation can occur after the last hydrocracking or dewaxing stage. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on the bottoms from the reaction stage (i.e., the hydrocracker bottoms). Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from 125° C. to 425° C., preferably 180° C. to 280° C., a hydrogen partial pressure from 500 psig (3.4 MPa) to 3000 psig (20.7 MPa), preferably 1500 psig (10.3 MPa) to 2500 psig (17.2 MPa), and liquid hourly space velocity from 0.1 $hr^{-1}$ to 5 $hr^{-1}$ LHSV, preferably 0.5 $hr^{-1}$ to 1.5 $hr^{-1}$. Additionally, a hydrogen treat gas rate of from 35.6 $m^3/m^3$ to 1781 $m^3/m^3$ (200 SCF/B to 10,000 SCF/B) can be used.

After hydroprocessing, one or more fractions from the hydroprocessing reaction system can have a viscosity index (VI) of at least 95, such as at least 105 or at least 110. The amount of saturated molecules in the one or more fractions from the hydroprocessing reaction system can be at least 90%, while the sulfur content of the one or more fractions can be less than 300 wppm. Thus, the one or more fractions from the hydroprocessing reaction system can be suitable for use as a Group II, Group II+, Group III, or Group III+ lubricant base oil.

EXAMPLES

Example 1

In this example, a heavy neutral Group-II lube base stock was produced. In this example, the feed to the reaction system corresponded to 70 vol % of two heavy distillate feedstocks and 30 vol % of extract fractions generated during solvent processing to produce a Group I lubricant from a separate feedstock. Table 1 provides a characterization of the components of the combined heavy distillate and extract feed.

TABLE 1

Example-I Feed Composition and Analyses

| | | HN Extract | LN Extract | Heavy Distillate A | Heavy Distillate B | Combined Feed |
|---|---|---|---|---|---|---|
| Composition | vol % | 21.1 | 8.0 | 45.4 | 25.5 | 100.0 |
| Density @ 100 C. | | 0.9577 | 0.9483 | 0.8944 | 0.893 | 0.9108 |
| Density @ 70 C. | | 0.9763 | 0.9678 | 0.9129 | 0.910 | 0.9293 |
| Sulfur | wt % | 4.69 | 4.57 | 3.53 | 2.81 | 3.56 |
| Nitrogen | ppmw | 2049 | 1372 | 1363 | 1142 | 1216 |
| Distillation (D2887) | | | | | | |
| IBP | ° F. | 698 | 599 | 679 | 671 | 643 |
| 10% | ° F. | 827 | 706 | 839 | 851 | 796 |
| 30% | ° F. | 976 | 749 | 921 | 939 | 890 |
| 50% | ° F. | 910 | 779 | 970 | 989 | 951 |
| 70% | ° F. | 950 | 907 | 1013 | 1030 | 1003 |
| 90% | ° F. | 1012 | 838 | 1070 | 1074 | 1060 |
| EBP | ° F. | 1157 | 882 | 1214 | 1133 | 1137 |
| Total Aromatics | μmole/g | 1859 | 2260.5 | 1158.7 | 1155.3 | 1420.7 |
| 1 Ring Aromatics | μmole/g | 132.9 | 299.1 | 222.9 | 239.6 | 228.3 |
| 2 Rings Aromatics | μmole/g | 647.4 | 760.4 | 372.6 | 368.9 | 468.3 |
| 3+ Rings Aromatics | μmole/g | 1078.7 | 1201 | 563.2 | 546.9 | 724.1 |
| Dry Wax | wt % | 3.5 | 1.9 | 12.9 | 9.3 | 9.9 |

The combined feed was hydroprocessed in a reaction system including a hydrotreating/hydrocracking stage, and a hydrodewaxing/hydrofinishing stage. The two stages had their own treat gas (100% hydrogen) and the liquid product from the first stage was distilled to a nominal 725° F.+ before being fed to the second stage.

The hydrotreating/hydrocracking stage comprised two reactors. The first reactor included a commercially available supported NiMo hydrotreating catalyst (NiMo-HDT). The second reactor was a stacked bed combination of 1) a bound USY zeolite catalyst with Pt as a supported hydrogenation metal (Pt/USY) and 2) the same NiMo catalyst used in the first reactor. The conditions used during the hydrotreating/hydrocracking stages are shown in Table 2.

TABLE 2

Example-I HDT/HDC Stage Operating Conditions

| | | |
|---|---|---|
| H2 Circulation Rate | scf/b | 4700 |
| Pressure | psig | 2100 |
| H2 Treat Gas Purity | mol % | 100% |
| LHSV (Overall) | $hr^{-1}$ | 0.5 |
| HDT - R1 (NiMo-HDT) | $hr^{-1}$ | 0.95 |
| HDC - R2 (Pt/USY and NiMo-HDT) | $hr^{-1}$ | 1.05 |
| Temperature | | |
| HDT (R1) | ° C. | 380 |
| HDC (R2) | ° C. | 376 |
| 725° F.+ bottom yield* | wt % | 60.1 |

*Feed to the HDW/HDF stage.

As indicated in Table 2, the bottoms from the hydrocracking stage were defined based on a 725° F. (385° C.) cut point. The bottoms were passed into the hydrodewaxing/hydrofinishing stage for production of a Group II lubricant basestock. The hydrodewaxing/hydrofinishing stage comprised two reactors. The first (hydrodewaxing) reactor included an initial bed of a commercial Pt/Pd hydrotreating catalyst followed by a bound ZSM-48 catalyst having a $SiO_2$:$Al_2O_3$ ratio of between 70:1 and 100:1 with Pt supported on the catalyst as a hydrogenation metal (Pt/ZSM-48). The second (hydrofinishing) reactor included a bound MCM-41 catalyst with a combination of Pt and Pd supported on the catalyst as hydrogenation metals (PtPd/MCM-41). Table 3 shows the conditions used in the hydrodewaxing/hydrofinishing stage. The conditions were selected in order to generate a 700° F.+ bottoms product having a −20° C. pour point that would be suitable for use as a Group II basestock.

TABLE 3

Example-I HDW/HDF Operating Conditions

| | | |
|---|---|---|
| H2 Circulation Rate | scf/b | 2500 |
| Pressure | psig | 2000 |
| H2 Treat Gas Purity | mol % | 100% |
| LHSV (Overall) | $hr^{-1}$ | 0.6 |
| R1 (Pt/Pd HDT + Pt/ZSM-48) | $hr^{-1}$ | 0.86 |
| R2 (PtPd/MCM-41) | $hr^{-1}$ | 2.00 |
| Temperature | | |
| HDW (R1) | ° C. | 341 |
| HDF (R2) | ° C. | 219 |
| 700° F.+ lube yield based on HDW/HDF Stage Feed | wt % | 93.4 |
| 700° F.+ lube yield based on HDT/HDC Stage Feed | wt % | 58.5 |

As shown in Table 3, 93 wt % of the bottoms from the hydrotreating/hydrocracking stage was incorporated into the final lubricant basestock product. The overall 700° F.+ yield was 58.5 wt % relative to the combined feed (70% heavy distillate/30% extracts). As shown in Table 4, the lubricant basestock product has a −20° C. pour point and satisfies the Group II basestock requirements of having a VI of at least 95.

TABLE 4

Example I - The 700° F.+ Lube Base Stock

| | | 700 F.+ Bottom |
|---|---|---|
| Density @ 100° C. | | 0.8250 |
| Pour Point | ° C. | −20 |
| KV @100° C. | cSt | 10.998 |
| KV @40° C. | cSt | 97.27 |
| SUS @100° F. (calculated) | | 477 |
| Viscosity Index | | 97.3 |
| Distillation (D2887) | | |
| IBP | ° F. | 678 |
| 10% | ° F. | 775 |
| 30% | ° F. | 854 |
| 50% | ° F. | 916 |
| 70% | ° F. | 974 |
| 90% | ° F. | 1043 |
| EBP | ° F. | 1121 |
| Total Aromatics | μmole/g | 58.8 |
| 1 Ring Aromatics | μmole/g | 49.84 |
| 2 Rings Aromatics | μmole/g | 7.10 |
| 3+ Rings Aromatics | μmole/g | 0.73 |

Example 2

In this example, a light neutral Group-III lube base stock was produced. In this example, the feed to the reaction system corresponded to 85 vol % of various distillates and wax and 15 vol % of extract fractions generated during solvent processing to produce a Group I lubricant from a separate feedstock. Table 5 shows the general composition of the combined feed for Example 2. FIG. 3 provides a more detailed characterization of the components of the combined heavy distillate and extract feed. It is noted that the extract fractions used in Example 2 were derived from the same source as the extract fractions used in Example 1.

TABLE 5

Example-II Feed Composition

| | | |
|---|---|---|
| LN Extract | vol % | 4.1 |
| HN Extract | vol % | 10.7 |
| Gp I Wax | vol % | 3.1 |
| Light Vacuum Distillate | vol % | 6.0 |
| Medium Vacuum Distillate | vol % | 40.1 |
| Heavy Vacuum Distillate | vol % | 36.0 |
| Total | vol % | 100.0 |

The reaction system and catalysts used in Example 2 were the same as those used for Example 1. However, the reaction conditions were varied (such as by changing the space velocities) as shown in Tables 6 and 7. Table 6 shows the conditions used for the hydrotreating/hydrocracking stage.

TABLE 6

| Example-II HDT/HDC Stage Operating Conditions | | |
|---|---|---|
| H2 Circulation Rate | scf/b | 4700 |
| Pressure | psig | 2100 |
| H2 Treat Gas Purity | mol % | 100% |
| LHSV (Overall) | $hr^{-1}$ | 0.67 |
| HDT R1(NiMo-HDT) | $hr^{-1}$ | 1.3 |
| HDC R2 (Pt/USY and NiMo-HDT) | $hr^{-1}$ | 1.4 |
| Temperature | | |
| HDT R1 | ° C. | 380 |
| HDC R2 | ° C. | 391 |
| 710-840° F. Heart Cut yield* | wt % | 14 |

*Feed to the HDW/HDF Stage.

As shown in Table 6, the bottoms generated from the hydrotreating/hydrocracking stage were not used as the feed for the dewaxing/hydrofinishing stage. Instead, in order to generate a Group III lubricant basestock product having a viscosity at 100° C. of 4.3 cSt, a 710° F. (377° C.)-840° F. (449° C.) "heart cut" of the product was used as the feed to the dewaxing/hydrofinishing stage. The reaction conditions used for the dewaxing/hydrofinishing stage are shown in Table 7.

TABLE 7

| Example-II HDW/HDF Stage Operating Conditions | | |
|---|---|---|
| H2 Circulation Rate | scf/b | 2500 |
| Pressure | psig | 2000 |
| H2 Treat Gas Purity | mol % | 100% |
| LHSV | | |
| HDW R1 | $hr^{-1}$ | 0.86 |
| HDF R2 | $hr^{-1}$ | 2.00 |
| Temperature | | |
| HDW R1 | ° F. | 626 |
| HDF R2 | ° F. | 466 |
| 700° F.+ lube yield based on HDW/HDF Stage Feed | wt % | 80.2 |
| 700° F.+ lube yield based on HDT/HDC Stage Feed | wt % | 10.9 |

The product from the dewaxing/hydrofinishing stage was fractionated to form the lubricant basestock product. As shown in Table 8, the basestock product satisfied the target requirements of a Group III basestock having a pour point of −15° C. or less.

TABLE 8

| The 700° F.+ Lube Base Stock | | |
|---|---|---|
| Density @ 100° C. | | 0.7841 |
| Pour Point | ° C. | −15 |
| KV @100° C. | cSt | 4.30 |
| KV @40° C. | cSt | 20.14 |
| SUS @100° F. (calculated) | | 106 |
| Viscosity Index | | 122 |
| Distillation (D2887) | | |
| IBP | ° F. | 653 |
| 10% | ° F. | 721 |
| 30% | ° F. | 765 |
| 50% | ° F. | 793 |
| 70% | ° F. | 823 |
| 90% | ° F. | 859 |
| EBP | ° F. | 938 |
| Total Aromatics | μmole/g | 4.12 |
| 1 Ring Aromatics | μmole/g | 3.5 |

TABLE 8-continued

| The 700° F.+ Lube Base Stock | | |
|---|---|---|
| 2 Rings Aromatics | μmole/g | 0.49 |
| 3+ Rings Aromatics | μmole/g | 0.03 |

Additional Embodiments and PCT/EP Clauses

Embodiment 1

A method for forming a lubricant product, comprising: providing a feedstock having a T5 boiling point of at least 600° F. (343° C.) and a T95 boiling point of 1150° F. (621° C.) or less; combining the feedstock with an extract fraction to form a combined feed, the extract fraction having a total aromatics content of at least 1500 μmole/g (e.g., at least 1700 μmole/g or at least 1800 μmole/g) and one or more of a 3+ ring aromatics content of at least 1000 μmole/g (e.g., at least 1050 μmole/g or at least 1200 μmole/g), a nitrogen content of at least 1300 ppm by weight (e.g., at least 1400 ppm by weight or at least 1500 ppm by weight), or a sulfur content of at least 4.5 wt % (e.g., at least 4.65 wt % or at least 4.8 wt %), the combined feed having a total aromatics content of at least 1240 μmole/g; hydroprocessing the combined feed under first effective hydroprocessing conditions in the presence of a hydrocracking catalyst to form a hydroprocessed effluent, the first effective hydroprocessing conditions comprising a hydrogen partial pressure of at least 1500 psig (10.3 MPag); hydroprocessing at least a portion of the liquid phase effluent in the presence of at least a dewaxing catalyst under second effective hydroprocessing conditions to form a dewaxed effluent; and fractionating the dewaxed effluent to form at least a lubricant base oil product having a viscosity index of at least 90 at a pour point of −18° C. or less, a sulfur content of 300 wppm or less, and an aromatics content of 10 wt % or less.

Embodiment 2

The method of Embodiment 1, wherein the combined feed has a 3+ ring aromatics content of at least 580 μmole/g (e.g., at least 650 μmole/g or at least 725 μmole/g), a nitrogen content of at least 1000 ppm by weight (e.g., at least 1200 ppm by weight or at least 1400 ppm by weight), a sulfur content of at least 3.0 wt % (e.g., at least 3.25 wt % or at least 3.5 wt %), or a combination thereof, or a combination of each thereof.

Embodiment 3

The method of Embodiment 1, wherein the combined feed has a 3+ ring aromatics content of at least 580 μmole/g, a nitrogen content of at least 1000 ppm by weight, and a sulfur content of at least 3.0 wt %.

Embodiment 4

The method of Embodiment 1, wherein the combined feed has a total aromatics content of at least 1400 μmole/g (e.g., at least 1500 ppm by weight or at least 1600 ppm by weight), a 3+ ring aromatics content of at least 700 μmole/g (e.g., at least 850 μmole/g or at least 1000 μmole/g), a nitrogen content of at least 1400 ppm by weight (e.g., at least 1500 ppm by weight or at least 1600 ppm by weight), a sulfur content of at least 3.5 wt % (at least 3.65 wt % or at least 3.8 wt %), or a combination thereof, or a combination of each thereof.

Embodiment 5

The method of Embodiment 1, wherein the combined feed has a total aromatics content of at least 1400 μmole/g, a 3+ ring aromatics content of at least 700 μmole/g, a nitrogen content of at least 1400 ppm by weight, and a sulfur content of at least 3.5 wt %.

Embodiment 6

The method of any of the above embodiments, wherein the combined feed has a 3+ ring aromatics content of at least 1000 μmole/g (e.g., at least 1050 μmole/g or at least 1200 μmole/g), a nitrogen content of at least 1300 ppm by weight (e.g., at least 1400 ppm by weight or at least 1500 ppm by weight), and a sulfur content of at least 4.5 wt % (e.g., at least 4.65 wt % or at least 4.8 wt %)

Embodiment 7

The method of any of the above embodiments, wherein the extract fraction is from 5 vol % (e.g., at least 10 vol %, or at least 15 vol %, or at least 20 vol %, or at least 25 vol %) to 40 vol % (e.g., 35 vol % or less of the combined feed, or 30 vol % or less, or 25 vol % or less, or 20 vol % or less) of the combined feed.

Embodiment 8

The method of any of the above embodiments, wherein the lubricant base oil product has a viscosity index of at least 120 at a pour point of −18° C. or less.

Embodiment 9

The method of any of the above embodiments, wherein the first fraction has a T95 boiling point of 1100° F. or less (e.g., 1050° F. or less), a T5 boiling point of at least 650° F., or a combination thereof.

Embodiment 10

The method of any of the above embodiments, wherein the first effective hydroprocessing conditions comprise exposing the combined feedstock to a hydrocracking catalyst under effective hydrotreating conditions, effective hydrocracking conditions, or a combination thereof.

Embodiment 11

The method of Embodiment 10, wherein the hydrocracking catalyst is USY, zeolite Beta, or a combination thereof.

Embodiment 12

The method of Embodiment 10 or 11, wherein the first effective hydroprocessing conditions further comprise exposing the combined feedstock to a hydrotreating catalyst under effective hydrotreating conditions, the effective hydrocracking conditions, or a combination thereof.

Embodiment 13

The method of any of the above embodiments, wherein the second effective hydroprocessing conditions comprise effective dewaxing conditions.

Embodiment 14

The method of any of the above embodiments, wherein the first effective hydroprocessing conditions comprise a temperature of 550° F. (288° C.) to 840° F. (449° C.), hydrogen partial pressures of from 1500 psig to 5000 psig (10.3 MPag to 34.6 MPag), and a hydrogen treat gas rate of from 35.6 $m^3/m^3$ to 1781 $m^3/m^3$ (200 SCF/B to 10,000 SCF/B), and wherein the second effective hydroprocessing conditions comprise a temperature of from 200 to 450° C., a hydrogen partial pressure of from 1.8 MPag to 34.6 MPag (250 psig to 5000 psig), and a hydrogen treat gas rate of from 35.6 $m^3/m^3$ (200 SCF/B) to 1781 $m^3/m^3$ (10,000 scf/B).

Embodiment 15

The method of any of the above embodiments, further comprising hydrofinishing at least a portion of the dewaxed effluent under effective hydrofinishing conditions.

Embodiment 16

The method of any of the above embodiments, wherein the extract fraction comprises a solvent extract from solvent processing of a second feedstock to form a lubricant basestock.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for forming a lubricant product, comprising:

providing a feedstock having a T5 boiling point of at least 600° F. (343° C.) and a T95 boiling point of 1150° F. (621° C.) or less;

combining the feedstock with an extract fraction from a solvent extraction process used to produce a Group I base stock to form a combined feed wherein from 5 vol % to 40 vol % of the combined feed is the extract fraction, the extract fraction having a total aromatics content of at least 1500 μmole/g and one or more of a 3+ ring aromatics content of at least 1000 μmole/g, a nitrogen content of at least 1300 ppm by weight, or a sulfur content of at least 4.5 wt %, the combined feed having a total aromatics content of at least 1240 μmole/g;

hydroprocessing the combined feed under first effective hydroprocessing conditions in the presence of a hydrocracking catalyst to form a hydroprocessed effluent, the first effective hydroprocessing conditions comprising a hydrogen partial pressure of at least 1500 psig (10.3 MPag);

hydroprocessing at least a portion of the liquid phase effluent in the presence of at least a dewaxing catalyst under second effective hydroprocessing conditions to form a dewaxed effluent; and fractionating the dewaxed effluent to form at least a lubricant base oil product having a viscosity index of at least 90 at a pour point of −18° C. or less, a sulfur content of 300 wppm or less, and an aromatics content of 10 wt % or less.

2. The method of claim 1, wherein the combined feed has a 3+ ring aromatics content of at least 580 μmole/g, a nitrogen content of at least 1000 ppm by weight, a sulfur content of at least 3.0 wt %, or a combination thereof.

3. The method of claim 2, wherein the combined feed has a 3+ ring aromatics content of at least 580 μmole/g, a nitrogen content of at least 1000 ppm by weight, and a sulfur content of at least 3.0 wt %.

4. The method of claim 1, wherein the combined feed has a total aromatics content of at least 1400 μmole/g, a 3+ ring aromatics content of at least 700 μmole/g, a nitrogen content of at least 1400 ppm by weight, a sulfur content of at least 3.5 wt %, or a combination thereof.

5. The method of claim 4, wherein the combined feed has a total aromatics content of at least 1400 μmole/g, a 3+ ring aromatics content of at least 700 μmole/g, a nitrogen content of at least 1400 ppm by weight, and a sulfur content of at least 3.5 wt %.

6. The method of claim 1, wherein the lubricant base oil product has a viscosity index of at least 120 at a pour point of −18° C. or less.

7. The method of claim 1, wherein the first fraction has a T95 boiling point of 1100° F. or less.

8. The method of claim 1, wherein the first fraction has a T5 boiling point of at least 650° F.

9. The method of claim 1, wherein the first effective hydroprocessing conditions comprise exposing the combined feedstock to a hydrocracking catalyst under effective hydrotreating conditions, effective hydrocracking conditions, or a combination thereof.

10. The method of claim 9, wherein the hydrocracking catalyst is USY, zeolite Beta, or a combination thereof.

11. The method of claim 9, wherein the first effective hydroprocessing conditions further comprise exposing the combined feedstock to a hydrotreating catalyst under effective hydrotreating conditions, the effective hydrocracking conditions, or a combination thereof.

12. The method of claim 1, wherein the second effective hydroprocessing conditions comprise effective dewaxing conditions.

13. The method of claim 1, wherein the first effective hydroprocessing conditions comprise a temperature of 550° F. (288° C.) to 840° F. (449° C.), hydrogen partial pressures of from 1500 psig to 5000 psig (10.3 MPag to 34.6 MPag), and a hydrogen treat gas rate of from 35.6 $m^3/m^3$ to 1781 $m^3/m^3$ (200 SCF/B to 10,000 SCF/B), and wherein the second effective hydroprocessing conditions comprise a temperature of from 200 to 450° C., a hydrogen partial pressure of from 1.8 MPag to 34.6 MPag (250 psig to 5000 psig), and a hydrogen treat gas rate of from 35.6 $m^3/m^3$ (200 SCF/B) to 1781 $m^3/m^3$ (10,000 scf/B).

14. The method of claim 1, further comprising hydrofinishing at least a portion of the dewaxed effluent under effective hydrofinishing conditions.

15. The method of claim 1, wherein the extract fraction comprises a solvent extract from solvent processing of a second feedstock to form a lubricant basestock.

16. The method of claim 1, wherein the lubricant base oil product has a viscosity index of at least 113.

17. The method of claim 1, wherein the lubricant base oil product has a viscosity index of at least 120.

* * * * *